US008107859B2

(12) United States Patent
Shiraki et al.

(10) Patent No.: US 8,107,859 B2
(45) Date of Patent: Jan. 31, 2012

(54) CONFIGURATION FOR AN AGITATION SYSTEM IN A DEVELOPING DEVICE AND PROCESS CARTRIDGE

(75) Inventors: Masatoshi Shiraki, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 445 days.

(21) Appl. No.: 12/239,325

(22) Filed: Sep. 26, 2008

(65) Prior Publication Data

US 2009/0087229 A1 Apr. 2, 2009

(30) Foreign Application Priority Data

Sep. 28, 2007 (JP) ..... 2007-254222

(51) Int. Cl.
*G03G 15/08* (2006.01)

(52) U.S. Cl. ..... 399/254; 399/258; 399/260; 399/262; 399/263

(58) Field of Classification Search ..... 399/253, 399/255, 263
See application file for complete search history.

(56) References Cited

U.S. PATENT DOCUMENTS

| | | | | |
|---|---|---|---|---|
| 5,729,803 | A | 3/1998 | Nakaue et al. | |
| 6,026,263 | A * | 2/2000 | Nakahata et al. | 399/263 |
| 2007/0258732 | A1 * | 11/2007 | Tanaka | 399/254 |

FOREIGN PATENT DOCUMENTS

| | | | |
|---|---|---|---|
| JP | 06-222665 A | | 8/1994 |
| JP | 09-138553 | | 5/1997 |
| JP | 10-020668 | | 1/1998 |
| JP | 11-272053 | | 10/1999 |
| JP | 2002-006613 A | | 1/2002 |
| JP | 2002006613 A | * | 1/2002 |
| JP | 2003-131480 | | 5/2003 |
| JP | 2006-126639 | | 5/2006 |

OTHER PUBLICATIONS

Machine translation of JP 2002-006613.*

Notification of Reasons of Rejection for Japanese Application No. 2007-254222 mailed Aug. 18, 2009.

* cited by examiner

*Primary Examiner* — David Gray

*Assistant Examiner* — David Bolduc

(74) *Attorney, Agent, or Firm* — Banner & Witcoff, Ltd.

(57) ABSTRACT

A developing device including a flexible agitating blade attached to an agitating member is described. The developing device may receive developer from a developer cartridge via a replenishing port. The replenishing port may be configured to prevent the flexible agitating blade from flinging toner outside of the developing device. In one example, an upstream opening of the replenishing port may be located such that, when a free end of the flexible agitating blade rotates to the opening, the surface of the agitating member has rotated to vertical or inclined downward.

11 Claims, 7 Drawing Sheets

7
61
T
61A
616
62
619
623B
61B
623
6

7
61
T
62
61A
T
623
61B
6

7
623
61
T
61A
T
615
623A
619
623B
614
6

7
623
61
611
623A
T
612
62
623B
619
615
61A
614
61B
6

CONFIGURATION FOR AN AGITATION SYSTEM IN A DEVELOPING DEVICE AND PROCESS CARTRIDGE

CROSS REFERENCE TO RELATED APPLICATION

This application claims priority from Japanese Patent Application No. 2007-254222, filed on Sep. 28, 2007, the entire subject matter of which is incorporated herein by reference.

TECHNICAL FIELD

Aspects of the invention relate to developing devices and process cartridges.

BACKGROUND

A known developing device includes a toner storing portion formed with a replenishing port in an upper portion, and a toner cartridge detachably attached to the developing device above the toner storing portion. The toner storing portion is configured to store toner to be supplied to a developing roller. In the developing device, toner stored in the toner cartridge is supplied into the toner storing portion as it falls down into the toner storing portion via the replenishing port.

The developing device further includes an agitating member that is configured to agitate toner supplied to the toner storing portion. Toner supplied to the toner storing portion is agitated by the agitating member, and moved between the inside and outside of the toner storing portion in the vicinity of the replenishing port, and may be leaked outside from between the developing device and the toner cartridge. When the agitating member has a flexible agitating blade that is configured to agitate toner in sliding contact with the inner surface of the toner storing portion, the agitating blade contacts the inner surface at its free end being warped while sliding on the inner surface. When the warped agitating blade arrives at the replenishing port, the agitating blade is fully extended, and toner remaining on a front surface of the agitating blade with respect to the rotation direction of the agitating member is flung outside, which may lead to toner leakage.

SUMMARY

One or more aspects of the invention provide a developing device and a process cartridge that are configured to prevent leakage of a developer from a developer storing portion.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention applies to a laser printer 1. It will be appreciated that aspects of the invention apply to other types of image forming apparatuses as well.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

Figure 1:
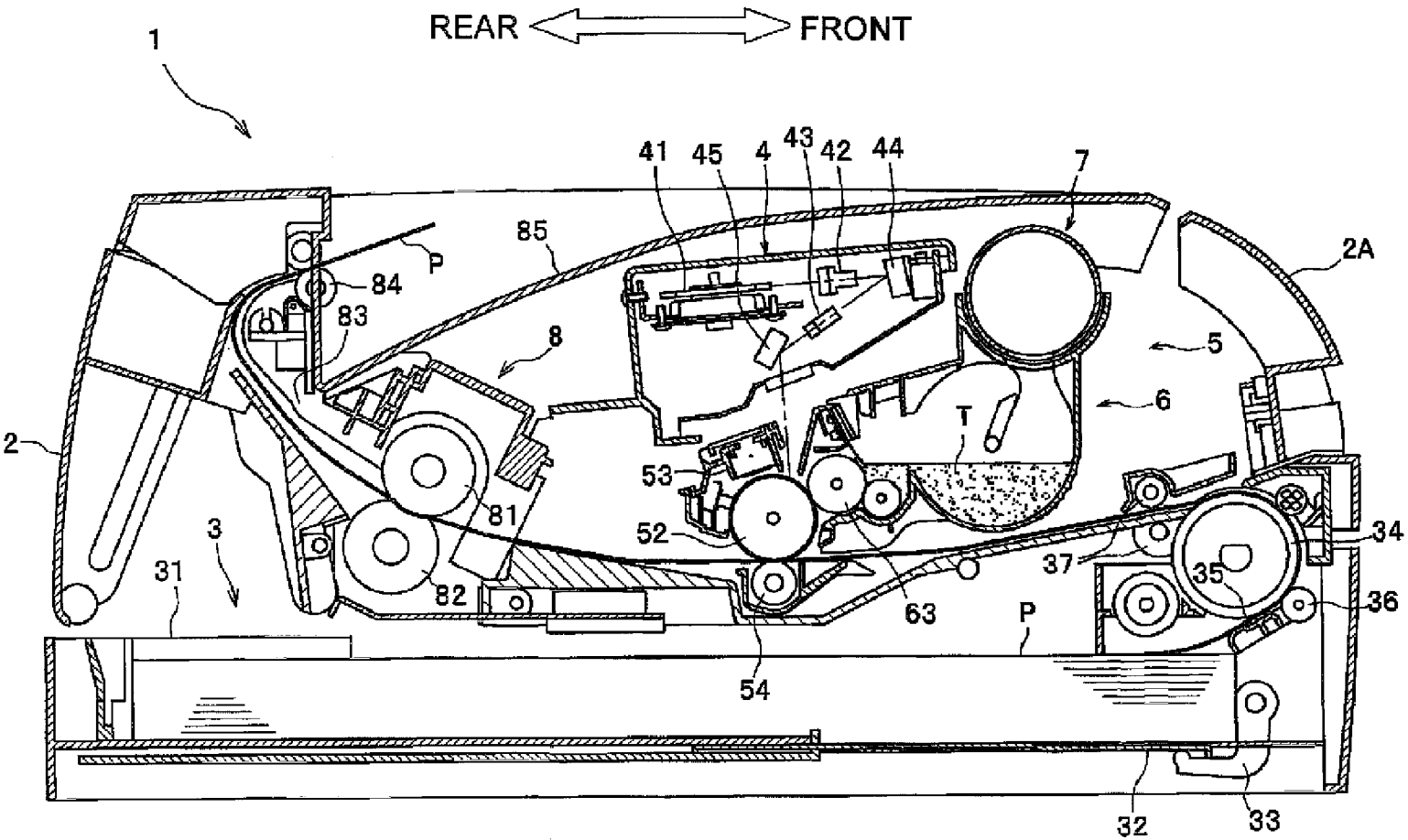
FIG. 1 is a side sectional view of an internal structure of a laser printer as an illustrative example of an image forming apparatus according to an illustrative embodiment of the invention.
Figure 2:
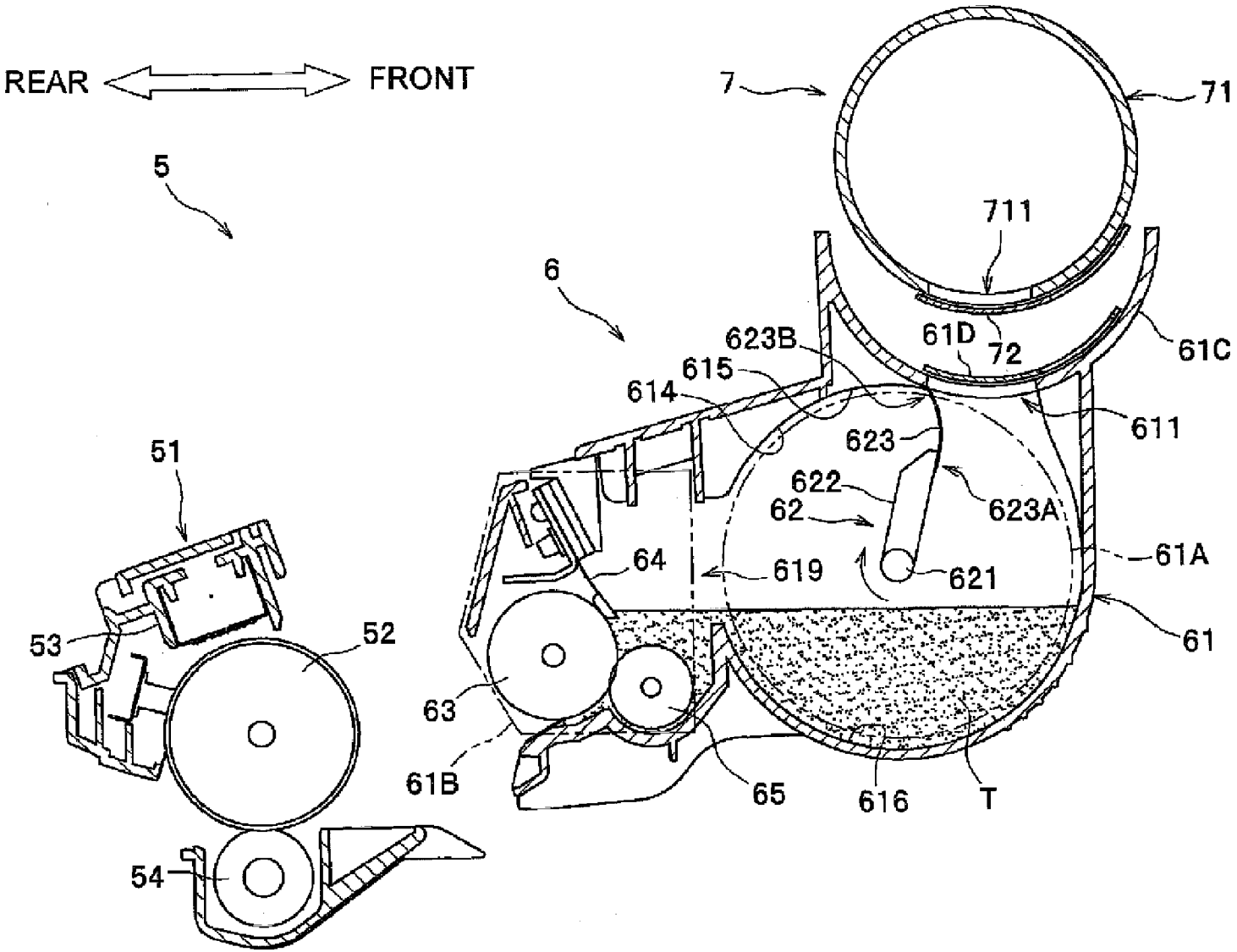
FIG. 2 is a side sectional view of a process cartridge disposed in the laser printer of FIG. 1.

For ease of discussion, in the following description, directions are defined as viewed from a user when operating the laser printer 1. The right side of FIGS. 1 and 2 is referred to as the front or front side of the laser printer 1, and the left side is referred to as the rear or rear side. The rear side of the sheet of FIGS. 1 and 2 is referred to as the right or right side of the laser printer 1, and the front side of the sheet of FIGS. 1 and 2 is referred to as the left or left side. The upper side of FIGS. 1 and 2 is referred to as the top or upper side, and the lower side is referred to as the bottom or lower side. With regard to various individual objects of the laser printer 1, sides of the individual objects will be similarly identified based on the arranged/attached position of the object on/in the laser printer 1.

As shown in FIG. 1, the laser printer 1 may mainly include a sheet supply portion 3, a light exposure unit 4, a process cartridge 5, and a fixing unit 8 in a body housing 2. The sheet supply portion 3 is configured to supply a sheet P inside the body housing 2. The process cartridge 5 is configured to form a toner image, or developer image, on the sheet P. The fixing unit 8 is configured to fix the toner image on the sheet P by heat.

The front surface of the body housing 2 contains a front cover 2A that is openable and closable. The process cartridge 5 is configured to be attached to and removed from the body housing 2 via an opening formed when the front cover 2A is opened (not shown).

The sheet supply portion 3 may include a sheet supply tray 31, a sheet pressing plate 32, and a lift lever 33. The sheet supply tray 31 is disposed in a bottom portion in the body housing 2 in a detachable manner. The sheet pressing plate 32 is pivotally disposed at the front side of the bottom portion of the sheet supply tray 31. The lift lever 33 is configured to lift the sheet pressing plate 32 from underneath. A sheet supply roller 34, a separation pad 35, and a pinch roller 36 are disposed above the front side of the sheet supply tray 31. Registration rollers 37 are disposed at the rear of the sheet supply roller 34. A stack of sheets P placed in the sheet supply tray 31 is lifted toward the sheet supply roller 34 by the lift lever 33 and the sheet pressing plate 32. Each sheet P is separated from the stack of sheets P by the sheet supply roller 34 and the separation pad 35 and conveyed through rollers 34, 36, 37 to the process cartridge 5.

The light exposure unit 4 is disposed in an upper portion in the body housing 2. The light exposure unit 4 may mainly include a laser emitting portion (not shown), a polygon mirror 41, lenses 42, 43, and reflecting mirrors 44, 45. In the light exposure unit 4, as shown in a broken line, a laser beam emitted from the light emitting portion, based on print data, is deflected by the polygon mirror 41, passes through the lens 42, is folded by the first reflecting mirror 44, passes through the lens 43, is reflected downward by the second reflecting mirror 45, and then directed to a surface of a photosensitive drum 52 of the process cartridge 5 by high speed scanning.

The process cartridge 5 is disposed below the light exposure unit 4, and configured to be attached to and removed from the body housing 2. As shown in FIG. 2, the process cartridge 5 may include a photosensitive member (e.g., photosensitive drum 52), a scorotron charger 53, a transfer roller 54, and a developing device 6, in a hollow cartridge frame 51 serving as an outer frame of the process cartridge 5. A developer cartridge (e.g., a toner cartridge 7) is detachably mounted to the process cartridge 5 or the developing device 6.

The photosensitive drum 52 is rotatably supported by the cartridge frame 51. In the photosensitive drum 52, a drum body is grounded and a surface is formed of a positively charged photosensitive layer.

The scorotron charger 53 is disposed away from the photosensitive drum 52, so as to face the photosensitive drum 52 from above. The scorotron charger 53 is configured to charge the surface of the photosensitive drum 52 uniformly and positively.

The transfer roller 54 is disposed in contact with the photosensitive drum 52 from below, and rotatably supported by the cartridge frame 51. During image transfer, a transfer bias is applied to the transfer roller 54.

The developing device 6 is detachably mounted to the cartridge frame 51. The developing device 6 may include a frame 61 forming a toner storing portion 61A and a developing portion 61B. The developing device 6 may further include an agitator 62 in the toner storing portion 61A, a developing roller 63, a layer-thickness regulating blade 64 and a supply roller 65 in the developing portion 61B. The frame 61 may rotatably support one or more of the agitator 62, the developing roller 63, and the supply roller 65.

The toner cartridge 7 may be detachably mounted to the frame 61 above the toner storing portion 61A of the developing device 6. When the toner cartridge 7 is mounted to the frame 61, a developer (e.g., toner T), stored in the toner cartridge 7 falls down under its own weight and is supplied into the toner storing portion 61A. The toner T in the toner storing portion 61A is agitated and conveyed to the developing portion 61B by rotation of the agitator 62, and supplied to the developing roller 63 by rotation of the supply roller 65. At this time, toner T is positively and frictionally charged between the supply roller 65 and the developing roller 63. Toner T supplied onto the developing roller 63 passes between the layer-thickness regulating blade 64 and the developing roller 63 by rotation of the developing roller 63, while the toner is uniformly regulated to a specified thickness as a thin layer and carried on the developing roller 63.

In the process cartridge 5, the surface of the photosensitive drum 52 is uniformly and positively charged by the scorotron charger 53, and then a laser beam from the light exposure unit 4 is scanned at high speed at the surface of the photosensitive drum 52. Thus, a potential in an area exposed to the laser beam drops, and an electrostatic latent image is formed based on image data. When the rotating developing roller 63 contacts the photosensitive drum 52, toner T carried on the developing roller 63 is supplied to the electrostatic latent image formed on the surface of the photosensitive drum 52. The toner T is selectively carried on the surface of the photosensitive drum 52, so that the electrostatic latent image becomes visible, and a toner image is formed on the surface of the photosensitive drum 52 by reversal phenomenon. As the photosensitive drum 52 and the transfer roller 54 rotate while sandwiching the sheet P therebetween, the sheet P passes between the photosensitive drum 52 and the transfer roller 54, and the toner image carried on the surface of the photosensitive drum 52 is transferred onto the sheet P.

As shown in FIG. 1, the fixing unit 8 is disposed at the rear of the process cartridge 5, or on a downstream side with respect to a sheet feeding direction. The fixing unit 8 may include a heat roller 81, and a pressure roller 82 disposed facing the heat roller 81. The heat roller 81 and the pressure roller 82 are configured to sandwich a sheet P therebetween. A sheet ejection path 83 and an ejection roller 84 are disposed downstream from the fixing unit 8 with respect to the sheet feeding direction. The toner image transferred onto the sheet P is fixed onto the sheet P by heat while passing between the heat roller 81 and the pressure roller 82. The sheet P transferred from the fixing unit 8 to the sheet ejection path 83 is ejected to a discharge tray 85 formed on the top surface of the body housing 2.

The developing device 6 may include the frame 61 forming the toner storing portion 61A and the developing portion 61B, the agitator 62, the developing roller 63, the layer-thickness regulating blade 64, and the supply roller 65.

As shown in FIG. 2, the frame 61 forms an outer casing, the toner storing portion 61A, the developing portion 61B, and a mounting portion 61C in which a toner cartridge 7 is received. The frame 61 may integrally include each part when formed as a single unit. Alternatively, the frame 61 may be constructed by assembling each part formed separately.

The toner storing portion 61A has a replenishing port 611 in an upper portion and an internal supply port 619 at the rear side. The internal supply port 619 communicates with the developing portion 61B.

The agitator 62 is disposed in the toner storing portion 61A and is configured to agitate the toner T in the toner storing portion 61A and convey the toner T via the internal supply port 619 to the developing portion 61B. The agitator 62 may include a rotary support shaft 621, a body 622, and an agitating blade 623.

The rotary support shaft 621 extends in a left-right direction of the toner storing portion 61A and is rotatably supported at both ends by sidewalls of the toner storing portion 61A. When power is transmitted from a motor (not shown) disposed in the body housing 2 to the rotary support shaft 621, the agitator 62 rotates in the toner storing portion 61A to agitate and convey toner T.

The body 622 is a plate-like member fixed to the rotary support shaft 621 along an axial direction thereof. An end of the agitating blade 623, e.g., a base end 623A, is fixed, e.g., bonded on a front surface of the body 622 with respect to a rotation direction of the agitator 62. The rotary support shaft 621 and the body 622 may be integrally formed.

The agitating blade 623 may be a flexible sheet that agitates toner T in sliding contact with ribs 614, 615 and a bottom portion 616 in the toner storing portion 61A and conveys the toner T to the developing portion 61B. One end of the agitating blade 623 is fixed to the body 622.

As shown in FIG. 2, the ribs 614, 615 are disposed at the rear of the replenishing port 611 in an upper portion of the toner storing portion 61A, and extend along the rotation direction of the agitator 62. The ribs 614, 615 include a plurality of ribs, respectively, and are arranged in the left-right direction of the toner storing portion 61A. The ribs 614, 615 are a part of a sliding portion of the toner storing portion 61A on which the agitator blade 623 slides.

In the following description, one end of the agitator blade 623 fixed to the body 622 is referred to as a base end 623A and the other end of the agitator blade 623 opposing the base end 623A and is referred to as a free end 623B. When the agitating blade 623 slidingly contacts the ribs 614, 615, or the bottom portion 616 of the toner storing portion 61A, the free end 623B warps rearward with respect to the rotation direction of the agitator 62. When the free end 623B faces the replenishing port 611 or the internal supply port 619, it returns to its original state and extends fully as shown in FIG. 3.

Figure 3:
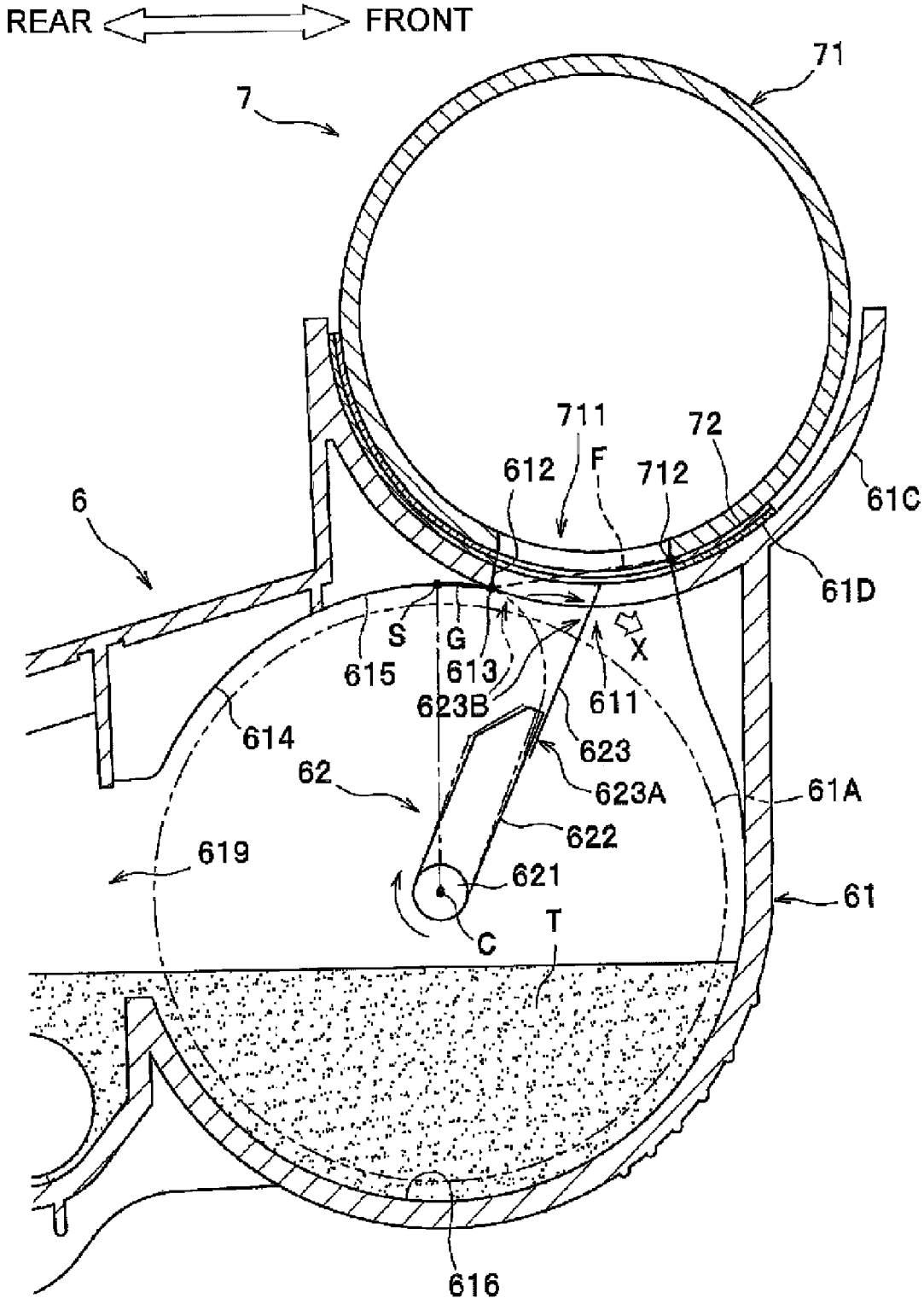
FIG. 3 is an enlarged side sectional view of a developing device.

As shown in FIG. 3, the replenishing port 611 has an end 612, which is disposed on an upstream side with respect to the rotation direction of the agitator 62, hereinafter referred to as an upstream-side end 612. The upstream-side end 612 is disposed in a position where a surface of the base portion 623A facing toward the front with respect to the rotation direction of the agitator 62 inclines downward when the free end 623B of the agitating blade 623 travels to the upstream-side end 612 as shown by a chain double-dashed line in FIG. 3.

Additionally, the upstream-side end 612 of the replenishing port 611 is positioned downstream from a position S with respect to the rotation direction of the agitator 62. In other words, the upstream-side end 612 is disposed at the front of the position S. The position S coincides with a position on the rib 615 where a center C of rotation of the agitator 62 is projected vertically upward. A plane G of the rib 615 inclines downward as it goes from the position S to the upstream-side end 612 of the replenishing port 611.

The toner cartridge 7 is configured to be attached to and removed from the mounting portion 61C disposed above the toner storing portion 61A of the developing device 6. The toner cartridge 7 may mainly include a cylindrical frame 71 and a shutter 72.

A lower portion of the frame 71 contains a supply port 711 to communicate with the replenishing port 611 when the toner cartridge 7 is mounted to the developing device 6. The volumetric capacity of the toner cartridge 7 is smaller than that of a combination of the toner storing portion 61A and the developing portion 61B of the developing device 6. More specifically, the volumetric capacity of the toner cartridge 7 is smaller than that of the toner storing portion 61A.

As shown in FIG. 2, the shutter 72 is configured to close the supply port 711 when the toner cartridge 7 is removed from the developing unit 7. The frame 61 of the developing device 6 includes a shutter 61D that is configured to close the replenishing port 611 when the toner cartridge 7 is removed from the developing device 6. The shutters 61D, 72 are configured to be rotated manually or electrically by means of a known mechanism to bring the replenishing port 611 and the supply port 711 to communicate with each other when the toner cartridge 7 is attached to the developing device 6.

As shown by a broken line in FIG. 3, a plane F is defined by connecting a lower end 613 of the upstream-side end 612 of the replenishing port 611 and a lower end 712 of the supply port 711 disposed on a downstream side with respect to the rotation direction of the agitator 62. In this embodiment, the plane F is disposed above the free end 623B of the agitating blade 623 that is fully extended.

The operation of the agitator 62 and the developing device 6 will be described with reference to FIGS. 4A to 4D.

Figures 4A, 4B, 4C, 4D:
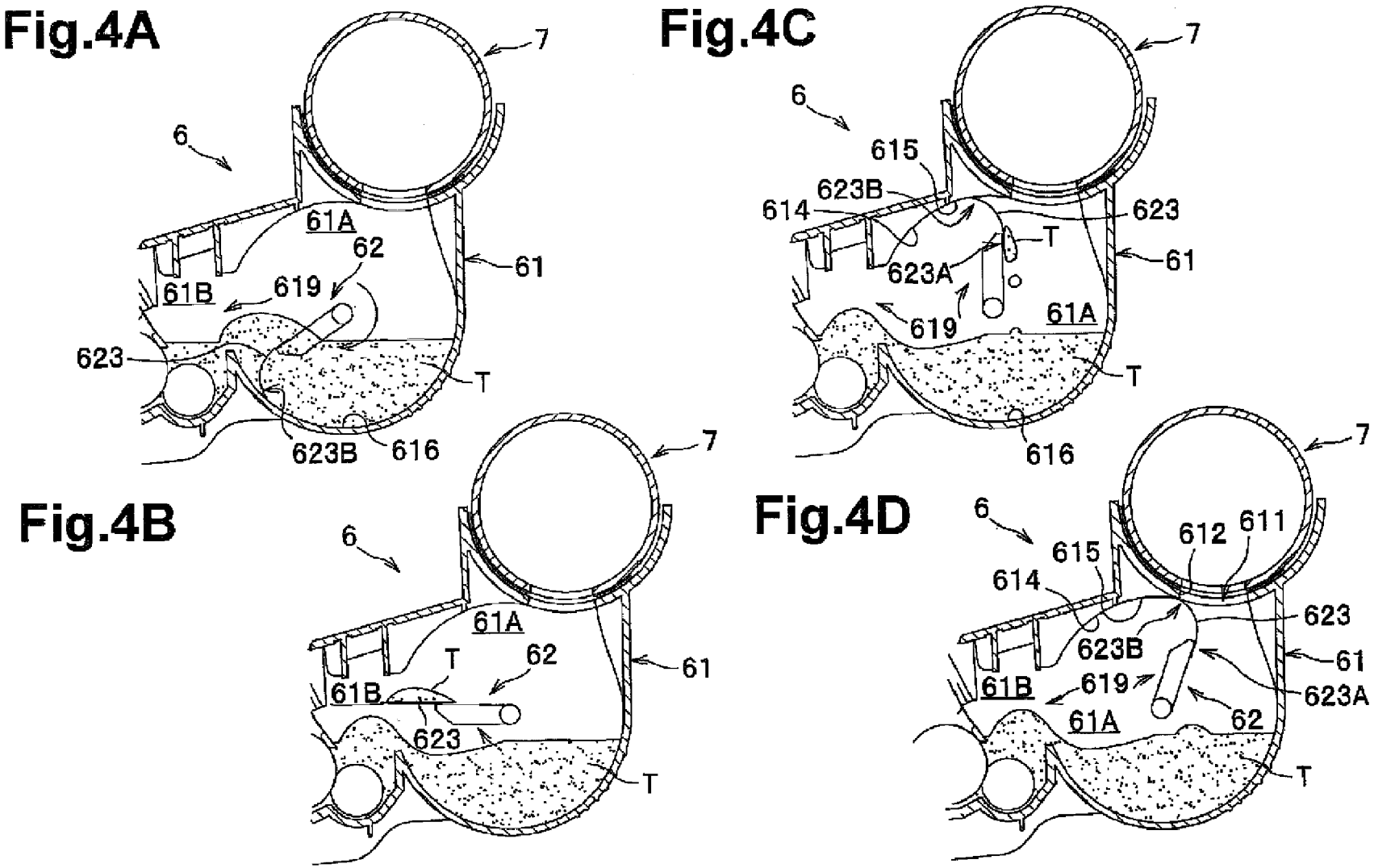
FIGS. 4A to 4D illustrate an operation of an agitator.

When the agitator 62 rotates, the free end 623B of the agitating blade 623 enters toner T accumulated in the bottom portion 616 of the toner storing portion 61A. As shown in FIG. 4A, the free end 623B of the agitating blade 623 conveys toner T to the developing portion 61B while sliding on the bottom portion 616 of the toner storing portion 61A.

Although it is not shown, when the level of toner T is low in the toner storing portion 61A, the free end 623B of the agitating blade 623 scoops up a small amount of toner T in sliding contact with the bottom portion 616 of the toner storing portion 61A, and extends fully at a lower end defining the internal supply port 619 to convey toner T to the developing device 6 with great force.

As shown in FIG. 4B, even when the agitator 62 rotates and the agitating blade 623 is extended fully at the internal supply port 619, toner T remains on the front surface of the agitating blade 623 with respect to the rotation direction thereof. As shown in FIG. 4C, when the agitator 62 rotates so that the free end 623B of the agitating blade 623 slides on an upper end of the internal supply port 619, and the ribs 614, 615, and the front surface at the base end 623A approaches vertically, toner T remaining on the front surface of the agitating blade 623 falls down to the bottom portion 616 of the toner storing portion 61A.

The developing device 6 includes the replenishing port 611 disposed in the above-described position. As shown in FIG. 4D, when the agitator 62 rotates and the free end 623B of the agitating blade 623 comes to the upstream-side end 612 of the replenishing port 611, the front surface at the base end 623A inclines downward, and almost all of the toner T remaining on the front surface of the agitating blade 623 falls down.

Generally, when an agitating blade is extended fully in a replenishing port, toner located on a front surface of the agitating blade with respect to its rotation direction is flung in a direction where the front surface of the agitating blade faces. In the developing device 6 according to the embodiment, as shown in FIG. 3, when the warped agitating blade 623 is fully extended in the replenishing port 611, a front surface of the agitating blade 623 with respect to the rotation direction faces toward a direction of an arrow X, and toner T remaining on the front surface of the agitating blade 623 is flung in the direction of the arrow X. Thus, toner T is not flung outside the toner storing portion 61A or into a gap formed between the mounting portion 61C and the toner cartridge 7.

Advantages of aspects of the laser printer 1 described above include the following.

The replenishing port 611 is provided in the position that, when the free end 623B of the agitating blade 623 arrives at the upstream-side end 612, the front surface at the base end 623A inclines downward. With this structure, before the warped free end 623B of the agitating blade 623 of the rotating agitator 62 is fully extended at the upstream-side end 612 of the replenishing port 611, almost all of toner T remaining on the front surface of the agitating blade 623 can be allowed to fall down. Even if the warped agitating blade 623 is fully extended, little toner T remains on the front surface of the agitating blade 623 with respect to the rotation direction, so that toner T can be prevented from flying outside the toner storing portion 61A. Thus, as toner T can be prevented from moving between the toner storing portion 61A and the toner cartridge 7, leakage of toner T from the toner storing portion 61A can be prevented.

The upstream-side end 612 of the replenishing port 611 is disposed on the downstream side from the position S of the rib 615 with respect to the rotation direction. Even when the warped agitating blade 623 is fully extended at the replenishing port 611, toner T does not fly upward, so that toner T can be prevented from flying outside the toner storing portion 61A. Thus, as toner T can be prevented from moving between the toner storing portion 61A and the toner cartridge 7 in the vicinity of the replenishing port 611, leakage of toner T from the toner storing portion 61A can be prevented.

The plane G on the rib 615 of the toner storing portion 61A inclines downward as it goes from the position S to the upstream-side end 612 of the replenishing port 611. With this configuration, even when the warped agitating blade 623 is fully extended at the replenishing port 611, toner T flies downward or in the direction of the arrow X in FIG. 3, so that toner T can be prevented from flying outside the toner storing portion 61A or in the gap formed between the mounting portion 61C and the toner cartridge 7. Thus, as toner T can be prevented from moving between the toner storing portion 61A and the toner cartridge 7 in the vicinity of the replenishing port 611, leakage of toner T from the toner storing portion 61A can be prevented.

The plane F connecting the lower end 613 of the replenishing port 611 and the lower end 712 of the supply port 711 is disposed above the free end 623B of the agitating blade 623 that is fully extended. Even when the agitating blade 623 is fully extended at the replenishing port 611, toner T does not fly upward higher than the plane F, and toner T can be prevented from flying outside the toner storing portion 61A or into the gap formed between the mounting portion 61C and the toner cartridge 7. Thus, toner T can be prevented from moving between the toner storing portion 61A and the toner cartridge 7 in the vicinity of the replenishing port 611, and leakage of toner T from the toner storing portion 61A can be prevented.

The toner capacity of the toner cartridge 7 is smaller than that of the toner storing portion 61A. When the toner cartridge 7 is mounted on the developing device 6, almost all of toner T stored in the toner cartridge 7 falls down and is supplied to the toner storing portion 61A via the supply port 711 and the replenishing port 611. According to this structure, an accumulation of toner T in the vicinity of the replenishing port 611, that is, in the vicinity of the gap between the mounting portion 61C and the toner cartridge 7, can be eliminated, and toner T can be prevented from entering the gap between the mounting portion 61C and the toner cartridge 7. Thus, when the toner cartridge 7 is removed from the developing device 6, leakage of toner T can be prevented.

Modifications of the invention will be described below. Parts substantially equivalent to those described above are denoted by the same reference numerals, and descriptions therefor will be omitted.

Figure 5A:
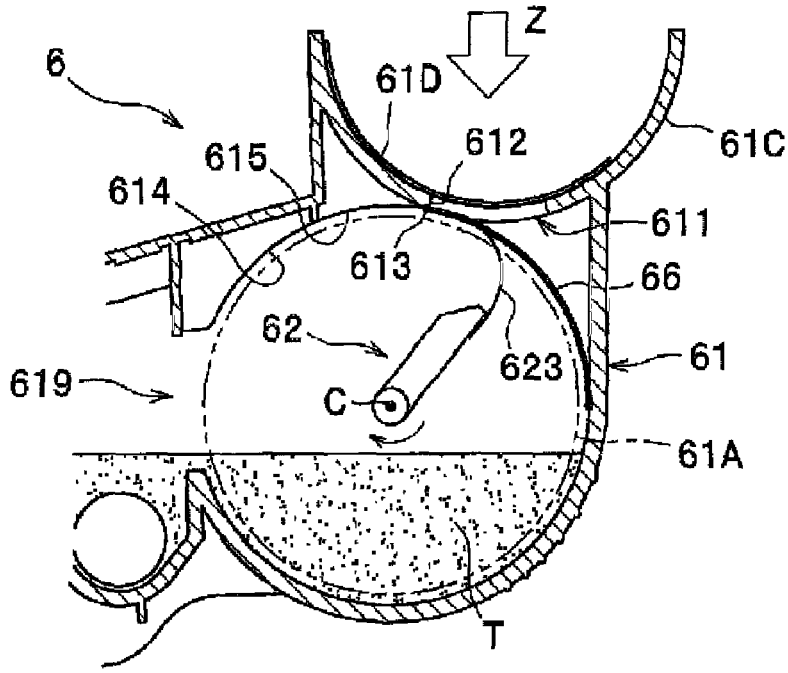
FIG. 5A is a side sectional view of a first modification in the developing device.
Figure 5B:
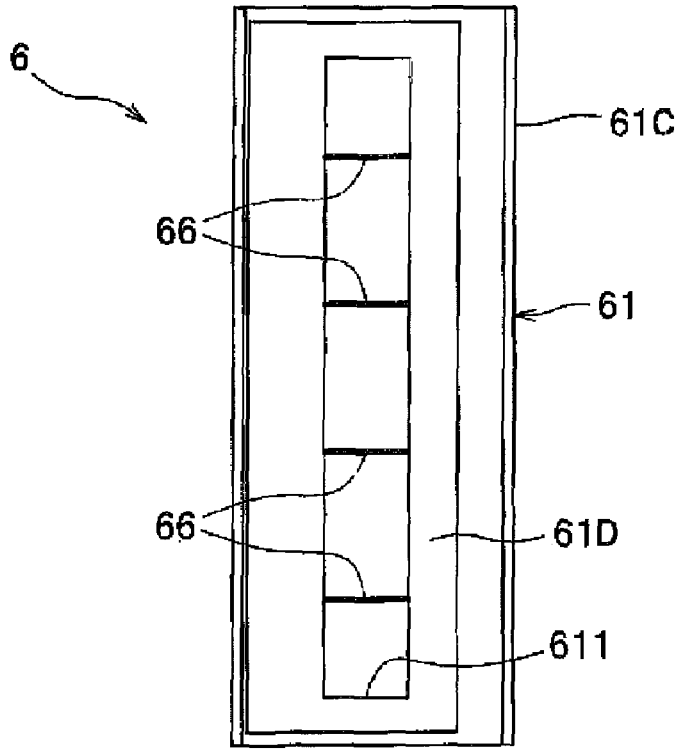
FIG. 5B is a fragmentary plan view looking in a direction of arrow Z in FIG. 5A.

As shown in FIG. 5A, a first modification of the developing device 6 further includes a guiding member 66 shaped, in a side view, in generally an arc centered on the center C of rotation of the agitator 62 and extending from the lower end 613 of the upstream-side end 612 of the replenishing port 611 toward the front of the toner storing portion 61A. As shown in FIG. 5B, a plurality of (e.g., four) guiding members 66 is arranged spacedly in the left-right direction of the developing device 6. Each guiding member 66 is formed of wire extending in a direction where the agitating blade 623 slidingly moves, that is, in the front-rear direction of the developing device 6. Toner T can be supplied from the toner cartridge 7 to the toner storing portion 61*a* via the guiding members 66. The guiding members 66 and the ribs 614, 615 of the toner storing portion 61A make a surface on which the agitating blade 623 slides substantially cylindrical.

The guiding members 66 provide communication between the inside and outside of the toner storing portion 61A, and enable the agitator 62 to rotate while causing the agitating blade 623 to slide on the ribs 614, 615 of the toner storing portion 61A and the guiding members 66. With this configuration, the agitating blade 623 is configured not to be extended fully from the warped state except for the internal supply port 619, and thus toner T can be prevented from being flung at the replenishing port 611 by the agitating blade 623. Thus, toner T can be prevented from being forced between the toner storing portion 61A and the toner cartridge 7 in the vicinity of the replenishing port 611, and leakage of toner T from the toner storing portion 61A can be prevented.

In one example, the guiding members 66 are formed of wires. However, the invention is not limited to such configuration. Guiding members may be formed of ribs extending in the direction where the agitating blade slidingly moves and be arranged spacedly in the left-right direction so as to make a surface on which the agitating blade slides substantially cylindrical with a sliding portion of a developer storing portion. Alternatively, a guiding member formed of a net may be disposed along the direction where the agitating blade slidingly moves in the vicinity of the replenishing port.

Figure 6:
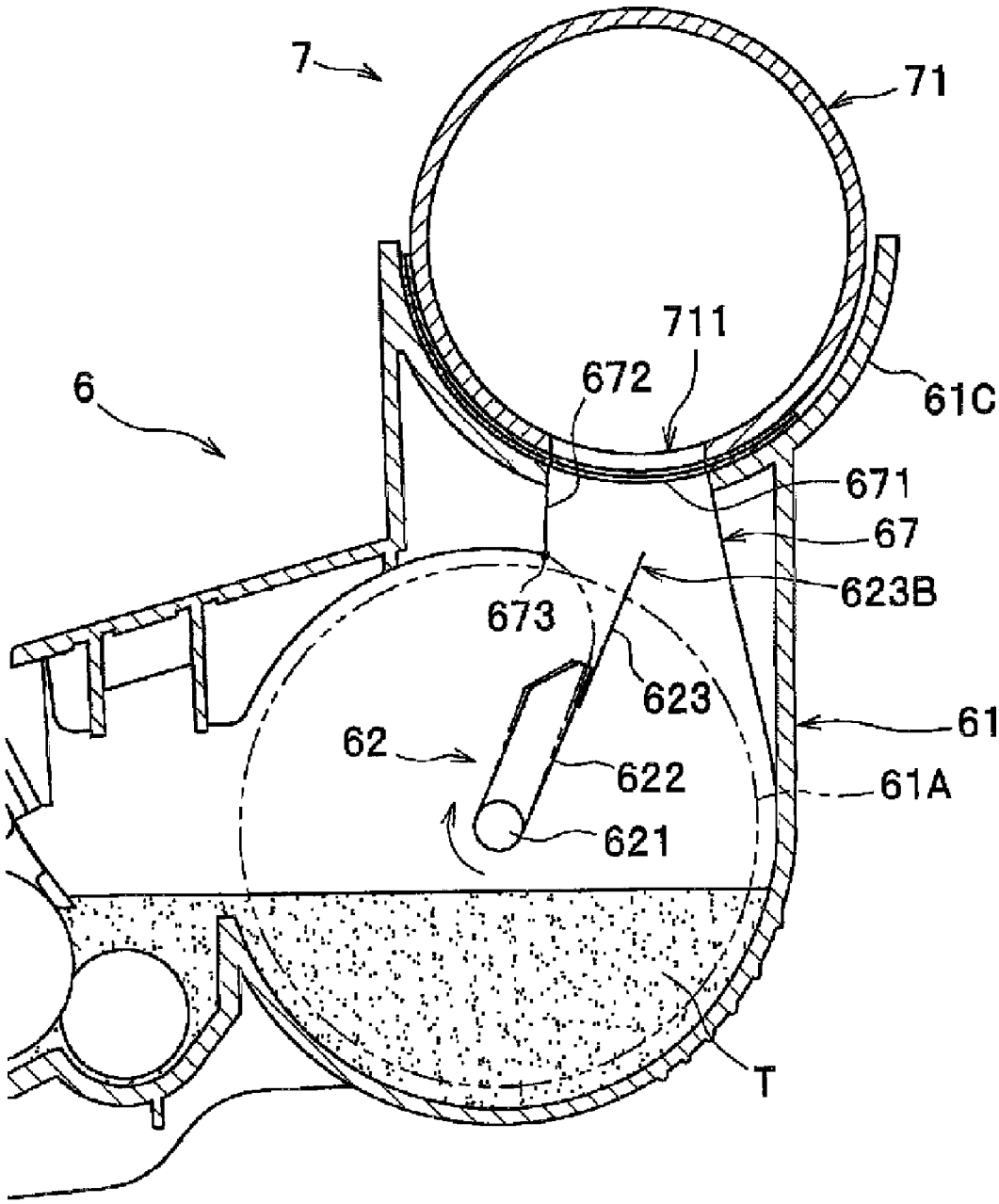
FIG. 6 is a side sectional view of a second modification in the developing device.

FIG. 6 illustrates a second modification of the developing device 6. The second modification of the developing device 6 includes a replenishing port 67, instead of the replenishing port 611 that is an opening in a wall surface of the frame 61 as shown in FIG. 3. The replenishing port 67 is formed like a passage extending upward from the upper portion of the toner storing portion 61A. The replenishing port 67 has an opening 671 defining an upper end of the replenishing port 67. The opening 671 is disposed higher than the free end 623B of the agitating blade 623 that is fully extended from its warped state. The replenishing port 67 is formed such that a lower end 673 of an upstream-side end 672 is disposed at the same position as the lower end 613 of the upstream-side end 612 of the replenishing port 611 in the above embodiment.

As the second modification of the developing device 6 includes the replenishing port 67 formed like a passage, toner T does not fly to the opening 671 of the replenishing port 67 even if the agitating blade 623 is fully extended from its warped state at a lower end of the replenishing port 67. Toner T can be prevented from flying outside the toner storing portion 61A or in the gap formed between the mounting portion 61C and the toner cartridge 7. Thus, toner T can be prevented from moving between the toner storing portion 61A and the toner cartridge 7 in the vicinity of the opening 671, and leakage of toner T from the toner storing portion 61A can be prevented.

Figure 7:
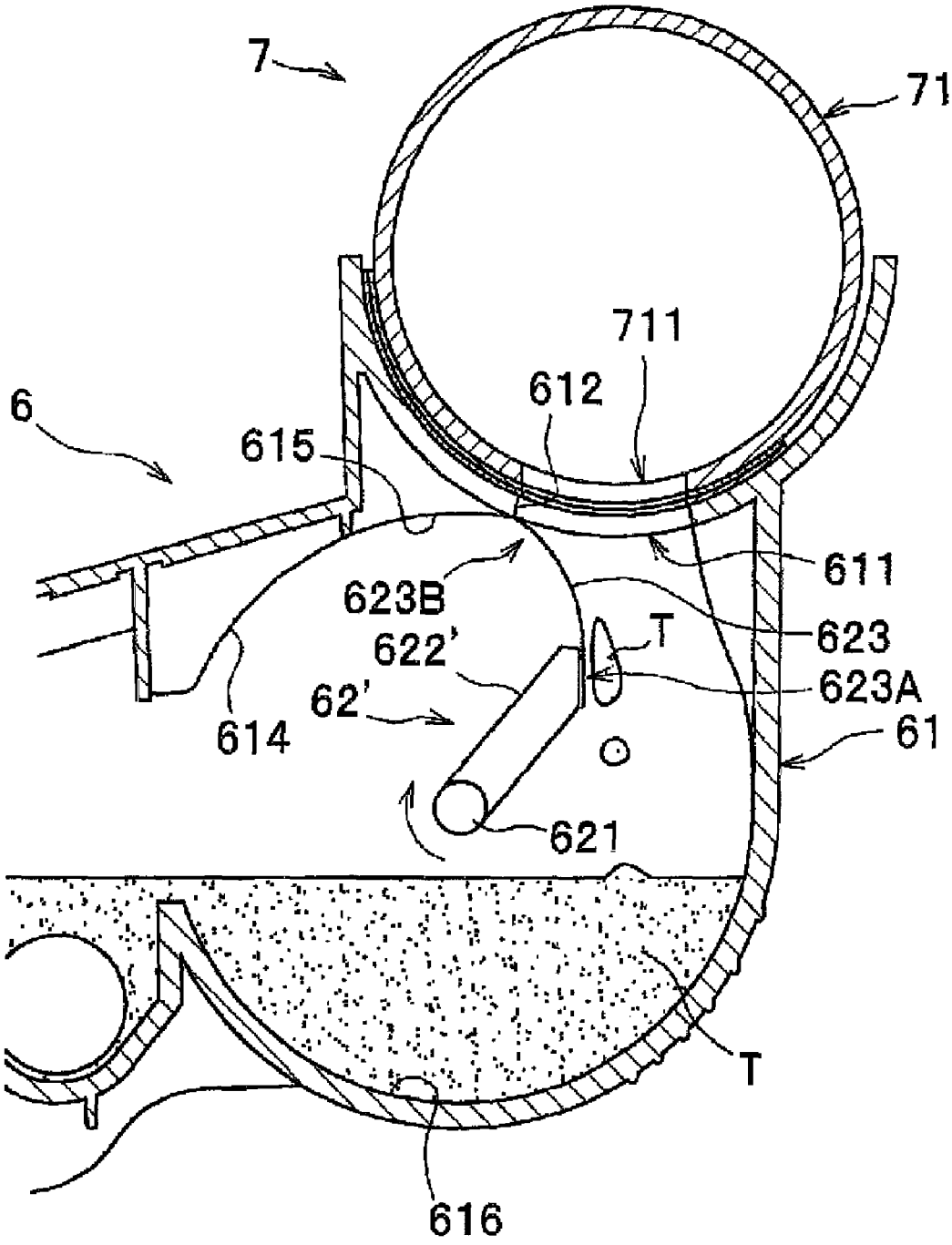
FIG. 7 is a side sectional view of a third modification in the developing device.

FIG. 7 illustrates a third modification of the developing device 6. As shown in FIG. 7, the third modification of the developing device 6 includes an agitator 62' having a body 622' whose shape has been changed from the body 622 of the agitator 62 shown in FIG. 2 in the embodiment. The body 622' is formed with an inclined surface on a front surface with respect to a rotation direction of the agitator 62' at an opposite end to the rotary support shaft 621. The base end 623A of the agitating blade 623 is fixed to the inclined surface.

In the third modification of the developing device 6 having the agitator 62', when the agitator 62' rotates and the free end 623B of the agitating blade 623 comes to the upstream-side end 612 of the replenishing port 611, the inclined surface of the body 622' becomes vertical. Thus, toner T remaining on a front surface of the agitating blade 623 can be caused to fall off before the agitating blade 623 is fully extended from its warped state, and the similar advantages to the developing device 6 of the embodiment can be achieved.

In the above embodiment, the photosensitive drum 52 is shown as an example of a photosensitive member, the agitator 62 is shown as an example of an agitating member, and toner T is shown as an example of a developer. The invention is not limited to these examples. Materials and structures may be changed as appropriate without departing from the scope of the invention.

Even with this configuration, when the developer cartridge is mounted in the developing device, almost all of the developer in the developer cartridge may drop off and be supplied to the developer storing portion, and then to the developing portion. Thus, accumulation of the developer in the vicinity of a gap between the developing device and the developer cartridge, and the developer can be prevented from entering the gap, and leakage of the developer can be prevented when the developing cartridge is removed from the developing device. In addition, when the developing cartridge is mounted in the developing device, the developer may be supplied to the developing portion and to the developing roller. Thus, image formation with favorable quality can be achieved just after the developer cartridge replacement.

One or more aspects of the invention may be applied to a case where the volume of the developer cartridge is greater than the sum of the volume of the developer storing portion and the volume of the developing portion. However, a more pronounced effect can be achieved from the case where the volume of the developer cartridge is smaller than the sum of the volume of the developer storing portion and the volume of the developing portion.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A developing device comprising:

a developer storing portion configured to store a developer, the developer storing portion formed with a replenishing port in an upper portion of the developer storing portion; and an agitating member disposed in the developer storing portion, the agitating member including a rotatable body and a flexible agitating blade fixed to the body at a base end of the flexible agitating blade, the flexible agitating blade being configured to agitate the developer in sliding contact with a sliding portion of the developer storing portion at a free end of the flexible agitating blade, wherein an upstream-side end of the replenishing port with respect to a rotation direction of the agitating member is disposed in a position such that a front surface of the body with respect to the rotation direction of the agitating member is vertical or inclined downward at the base end of the agitating member when the free end of the flexible agitating blade arrives at the upstream-side end of the replenishing port, wherein the sliding portion of the developer storing portion inclines downward from a position on the sliding portion, with respect to the rotation direction of the agitating member, to the upstream-side end of the replenishing port, wherein the position is defined as a vertically upward projection of a center of rotation of the agitating member on the developer storing portion, and wherein the sliding portion of the developer storing portion ends at the upstream-side end of the replenishing port.

2. The developing device according to claim 1, wherein the upstream-side end of the replenishing port is disposed downstream from the position on the sliding portion with respect to the rotation direction of the agitating member.

3. The developing device according to claim 1, wherein the replenishing port is formed as a passage extending upward from the upper portion of the developer storing portion, and an upper opening of the replenishing port is disposed above the free end of the flexible agitating blade when fully extended.

4. The developing device according to claim 1, further comprising:

a guiding member configured to provide communication between an inside and an outside of the developer storing portion, the guiding member and the sliding portion making a surface substantially cylindrical on which the flexible agitating blade slides.

5. The developing device according to claim 4, wherein the guiding member is formed of wire extending in a direction where the flexible agitating blade slidingly moves.

6. The developing device according to claim 4, wherein the guiding member includes ribs.

7. The developing device according to claim 1, configured to receive a developing cartridge disposed in the upper portion of the developer storing portion, wherein the developing cartridge has a smaller capacity than a combination of the developer storing portion and a developing portion where a developing roller is disposed.

8. The developing device according to claim 7, wherein the developing cartridge is formed with a supply port configured to communicate with the replenishing port, and wherein the free end of the flexible agitating blade when fully extended is always below a plane connecting a lower end of the upstream-side end of the replenishing port and a lower end of the supply port disposed on a downstream side with respect to the rotation direction of the agitating member.

9. The developing device according to claim 7, wherein the developing cartridge has a smaller capacity than the developer storing portion.

10. A process cartridge comprising:

a developing device including a developing roller;

a developer storing portion configured to store a developer to be supplied to the developing roller, the developer storing portion formed with a replenishing port in an upper portion of the developer storing portion; and an agitating member disposed in the developer storing portion, the agitating member including a rotatable body and a flexible agitating blade fixed to the body a base end of the flexible agitating blade, the flexible agitating blade being configured to agitate the developing toner in sliding contact with a sliding portion of the developer storing portion at a free end of the flexible agitating blade, wherein an upstream-side end of the replenishing port with respect to a rotation direction of the agitating member is disposed in a position such that a front surface of the body with respect to the rotation direction of the agitating member is vertical or inclined downward at the base end of the agitating member when the free end of the flexible agitating blade arrives at the upstream-side end of the replenishing port, wherein the sliding portion of the developer storing portion inclines downward from a position on the sliding portion, with respect to the rotation direction of the agitating member, to the upstream-side end of the replenishing port, wherein the position is defined as a vertically upward projection of a center of rotation of the agitating member on the developer storing portion, and wherein the sliding portion of the developer storing portion ends at the upstream-side end of the replenishing port; and a photosensitive member configured to carry an electrostatic latent image thereon and configured to cause the latent image to develop a developer image with the developer supplied from the developing device.

11. A developing device comprising:

a developer storing portion configured to store a developer, the developer storing portion formed with a replenishing port in an upper portion of the developer storing portion; and an agitating member disposed in the developer storing portion, the agitating member including a rotatable body and a flexible agitating blade fixed to the body at a base end of the flexible agitating blade, the flexible agitating blade being configured to agitate the developer in sliding contact with a sliding portion of the developer storing portion at a free end of the flexible agitating blade, and wherein an upstream-side end of the replenishing port with respect to a rotation direction of the agitating member is disposed in a position such that a front surface of the body with respect to the rotation direction of the agitating member is vertical or inclined downward at the base end of the agitating member when the free end of the flexible agitating blade arrives at the upstream-side end of the replenishing port, and wherein an entirety of the flexible agitating blade is fully extended and substantially straight when the free end of the flexible agitating blade arrives at the upstream-side end of the replenishing port.

* * * * *